US008602737B2

(12) United States Patent
Garcia-Crespo

(10) Patent No.: US 8,602,737 B2
(45) Date of Patent: Dec. 10, 2013

(54) SEALING DEVICE

(75) Inventor: Andres Jose Garcia-Crespo, Greenville, SC (US)

(73) Assignee: General Electric Company, Schenectady, NY (US)

( * ) Notice: Subject to any disclaimer, the term of this patent is extended or adjusted under 35 U.S.C. 154(b) by 777 days.

(21) Appl. No.: 12/823,483

(22) Filed: Jun. 25, 2010

(65) Prior Publication Data

US 2011/0318187 A1 Dec. 29, 2011

(51) Int. Cl.
*F01D 5/30* (2006.01)

(52) U.S. Cl.
USPC ..... 416/204 R; 416/220 R; 416/219 R; 416/248

(58) Field of Classification Search
USPC ..... 416/204 R, 204 A, 219 R, 220 R, 220 A, 416/219 A, 248
See application file for complete search history.

(56) References Cited

U.S. PATENT DOCUMENTS

| | | | | |
|---|---|---|---|---|
| 3,501,249 | A | 6/1968 | Scalzo et al. | |
| 5,967,745 | A | 10/1999 | Tomita et al. | |
| 6,086,329 | A | 7/2000 | Tomita et al. | |
| 6,120,249 | A | 9/2000 | Hultgren et al. | |
| 6,189,891 | B1 | 2/2001 | Tomita et al. | |
| 6,220,814 | B1 | 4/2001 | Brushwood et al. | |
| 6,273,683 | B1 | 8/2001 | Zagar et al. | |
| 6,315,301 | B1 | 11/2001 | Umemura et al. | |
| 6,416,282 | B1 | 7/2002 | Beeck et al. | |
| 6,481,967 | B2 | 11/2002 | Tomita et al. | |
| 6,561,764 | B1 | 5/2003 | Tiemann | |
| 6,945,749 | B2 | 9/2005 | De Cardenas | |
| 7,264,448 | B2 | 9/2007 | Garner | |
| 8,011,894 | B2 * | 9/2011 | Arness et al. | 416/219 R |
| 2005/0281667 | A1 | 12/2005 | Liang | |
| 2007/0014668 | A1 | 1/2007 | Engle | |
| 2007/0080505 | A1 | 4/2007 | Nereim | |
| 2008/0008584 | A1 | 1/2008 | Shteyman et al. | |
| 2009/0148298 | A1 * | 6/2009 | Strohl et al. | 416/219 R |

* cited by examiner

*Primary Examiner* — Dwayne J White
(74) *Attorney, Agent, or Firm* — Dority & Manning, P.A.

(57) ABSTRACT

A sealing device for sealing a gap between a dovetail of a bucket assembly and a rotor wheel is disclosed. The sealing device includes a cover plate configured to cover the gap and a retention member protruding from the cover plate and configured to engage the dovetail. The sealing device provides a seal against the gap when the bucket assembly is subjected to a centrifugal force.

20 Claims, 6 Drawing Sheets

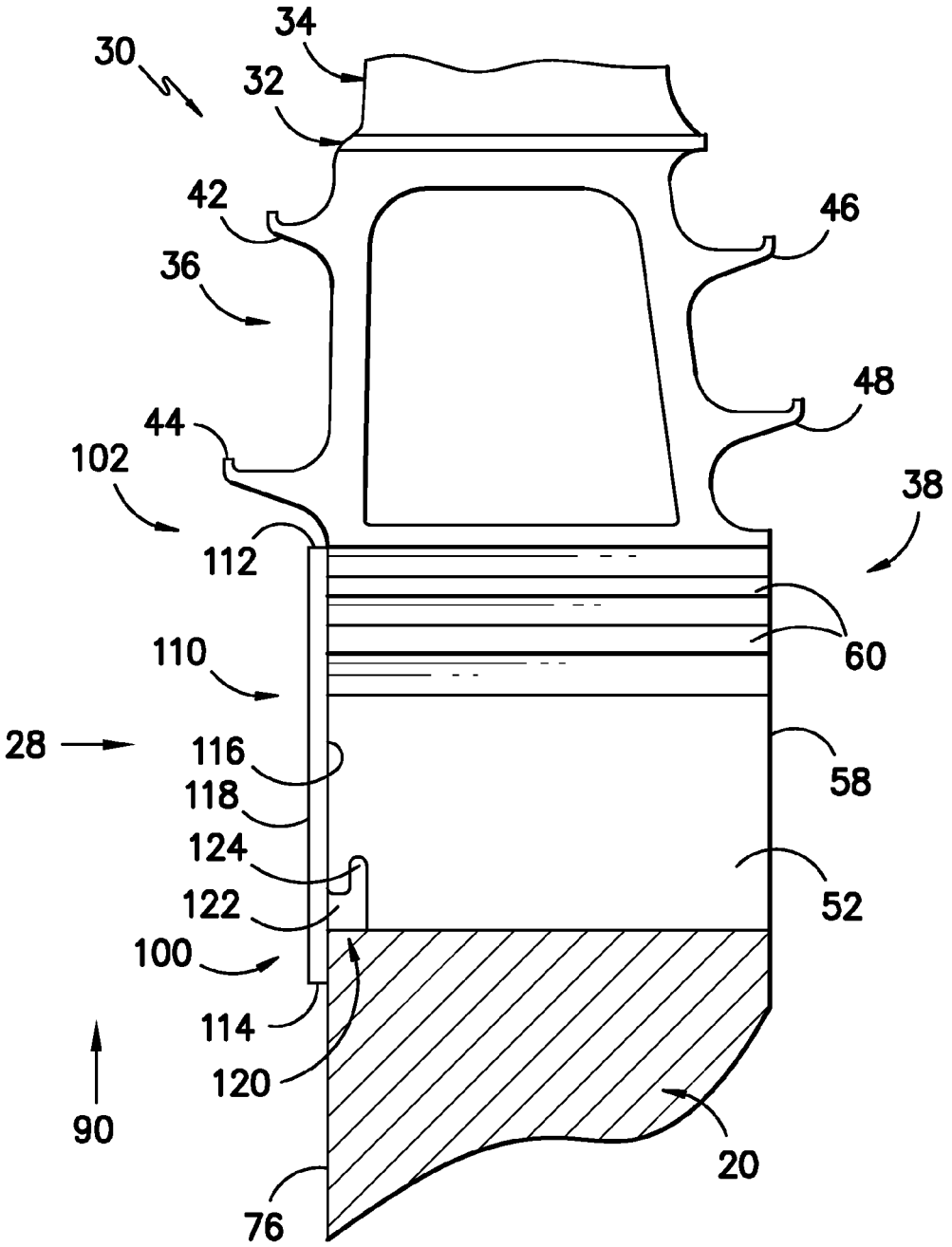
FIG. –5–

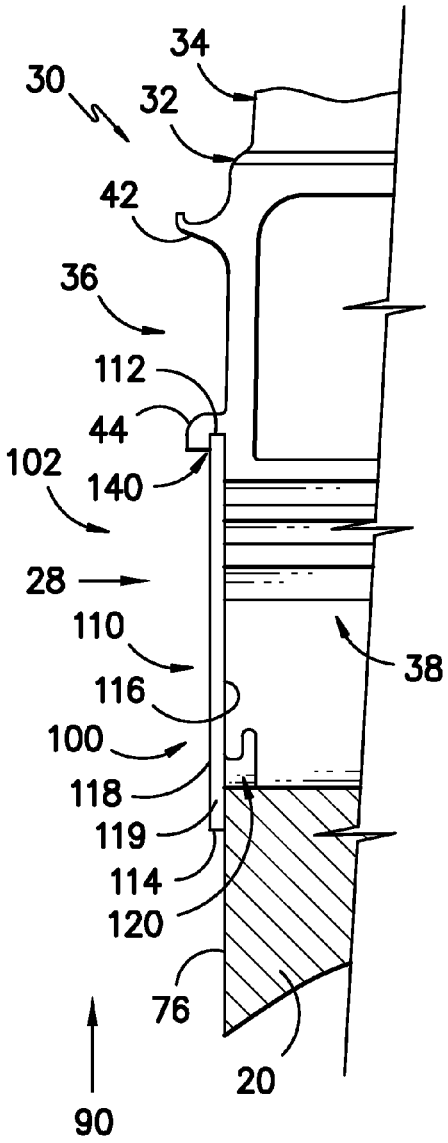
FIG. –6–
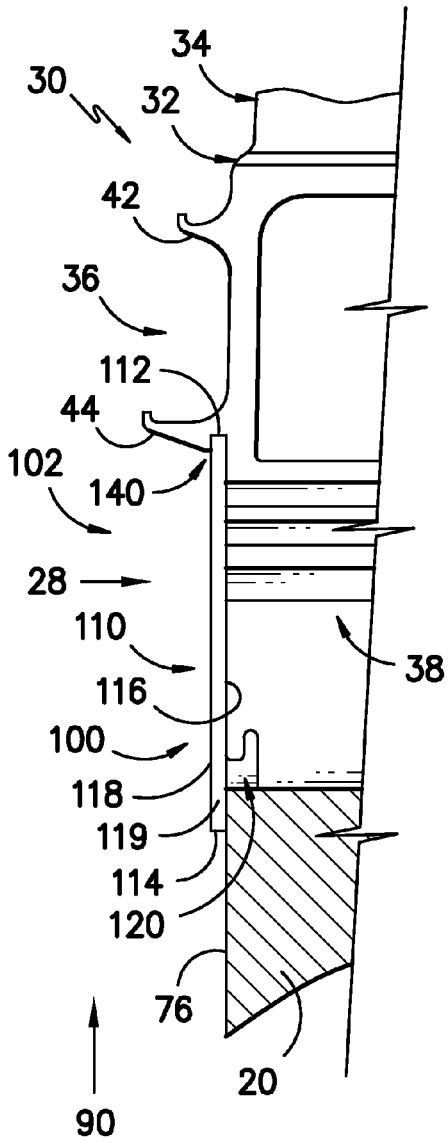
FIG. –7–

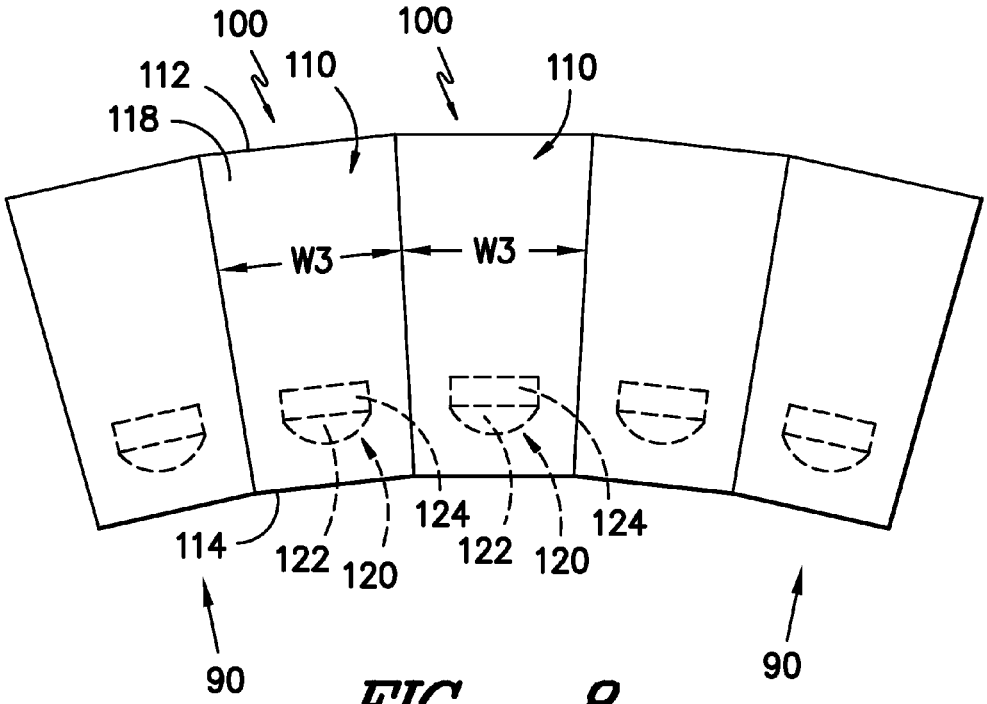
FIG. —8—
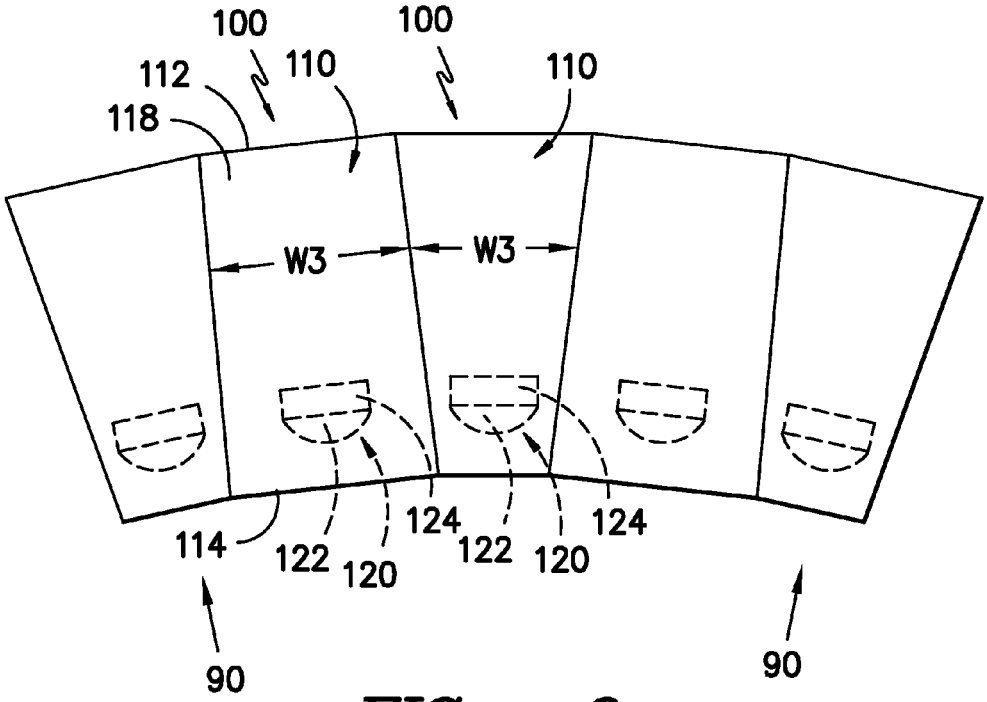
FIG. —9—

SEALING DEVICE

FEDERAL RESEARCH STATEMENT

This invention was made with Government support under contract number DE-FC26-05NT42643 awarded by the Department of Energy. The Government may have certain rights in the invention.

FIELD OF THE INVENTION

The subject matter disclosed herein relates generally to hot gas path components, and more specifically to sealing devices for sealing adjacent hot gas path components.

BACKGROUND OF THE INVENTION

Gas turbine systems are widely utilized in fields such as power generation. A conventional gas turbine system includes a compressor, a combustor, and a turbine. During operation of the gas turbine system, various components in the system are subjected to high temperature flows, which can cause the components to fail. Since higher temperature flows generally result in increased performance, efficiency, and power output of the gas turbine system, the components that are subjected to high temperature flow must be cooled to allow the gas turbine system to operate at increased temperatures.

Turbine buckets are one example of a hot gas path component that must be cooled. Imperfectly sealed bucket dovetails, which provide an interface between the buckets and a rotor wheel in a gas turbine assembly, may allow hot gas to enter the bucket through gaps between the dovetail and the rotor wheel, and the hot gas can cause these various components to fail.

Various strategies are known in the art for cooling the bucket dovetails and preventing hot gas ingestion. For example, many prior art strategies utilize sealing devices mounted to the rotor wheel for sealing the interface between the bucket dovetail and rotor wheel. However, mounting a sealing device to a rotor wheel requires that the rotor wheel be able to carry the sealing device. Thus, the rotor wheel must be specially manufactured to include features for carrying sealing devices, which is a costly and inefficient process. Further, other prior art strategies utilize sealing devices that are required to interface with portions of the bucket that do not require a sealing device for sealing. These portions of the bucket must also be unnecessarily specially manufactured to accommodate the sealing devices.

Thus, a sealing device for sealing an interface between a bucket assembly dovetail and a rotor wheel in a gas turbine system would be desired in the art. For example, a sealing device that attaches directly to the dovetail, and that requires minimal modification of the dovetail, would be advantageous. Further, a sealing device that could be retro-fitted to an existing bucket, and that requires no modification of the rotor wheel, would be desired.

BRIEF DESCRIPTION OF THE INVENTION

Aspects and advantages of the invention will be set forth in part in the following description, or may be obvious from the description, or may be learned through practice of the invention.

In one embodiment, a sealing device for sealing a gap between a bucket assembly dovetail and a rotor wheel is disclosed. The sealing device includes a cover plate configured to cover the gap, and a retention member protruding from the cover plate and configured to engage the dovetail. The sealing device provides a seal against the gap when the bucket assembly is subjected to a centrifugal force.

In another embodiment, a dovetail assembly for providing an interface and sealing a gap between a bucket assembly and a rotor wheel is disclosed. The dovetail assembly includes a dovetail having an upstream surface, a downstream surface, a pressure side surface, a suction side surface, and a base surface, and defines a retention slot. The dovetail assembly further includes a sealing device disposed adjacent the upstream surface, the sealing device comprising a cover plate configured to cover the gap and a retention member protruding from the cover plate and engaged in the retention slot. The sealing device provides a seal against the gap when the bucket assembly is subjected to a centrifugal force.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 5 is a side view of one embodiment of a bucket assembly and sealing device of the present disclosure disposed in a rotor wheel;

FIG. 6 is a partial side view of another embodiment of a bucket assembly and sealing device of the present disclosure disposed in a rotor wheel;

FIG. 7 is a partial side view of another embodiment of a bucket assembly and sealing device of the present disclosure disposed in a rotor wheel;

FIG. 8 is partial front view of one embodiment of an annular array of sealing devices of the present disclosure; and FIG. 9 is partial front view of another embodiment of an annular array of sealing devices of the present disclosure.

DETAILED DESCRIPTION OF THE INVENTION

Figure 1:
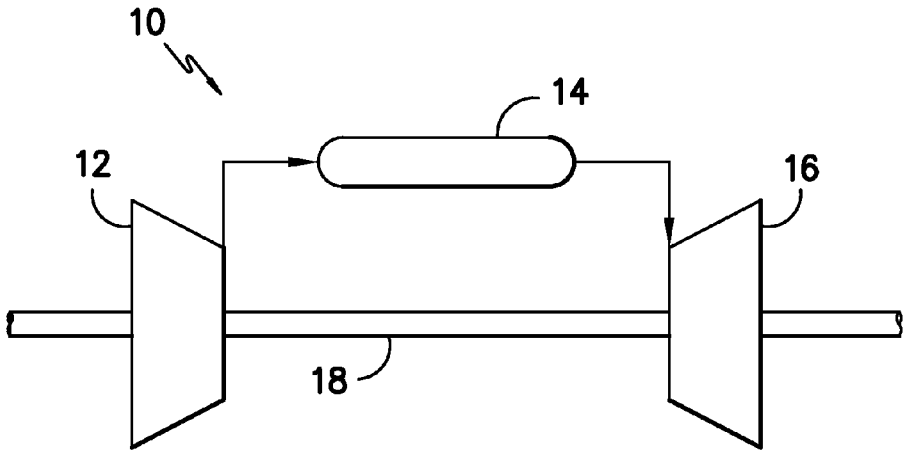
FIG. 1 is a schematic illustration of a gas turbine system.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, a combustor 14, and a turbine 16. The compressor 12 and turbine 16 may be coupled by a shaft 18. The shaft 18 may be a single shaft or a plurality of shaft segments coupled together to form shaft 18. A rotor wheel 20 or plurality of rotor wheels 20 (see FIGS. 4 through 7) may be coupled to the shaft 18 and may rotate about the shaft 18, as is generally known in the art. It should be understood that the present disclosure is not limited to a gas turbine system 10, but may be, for example, a steam turbine system or any other suitable system.

Figure 2:
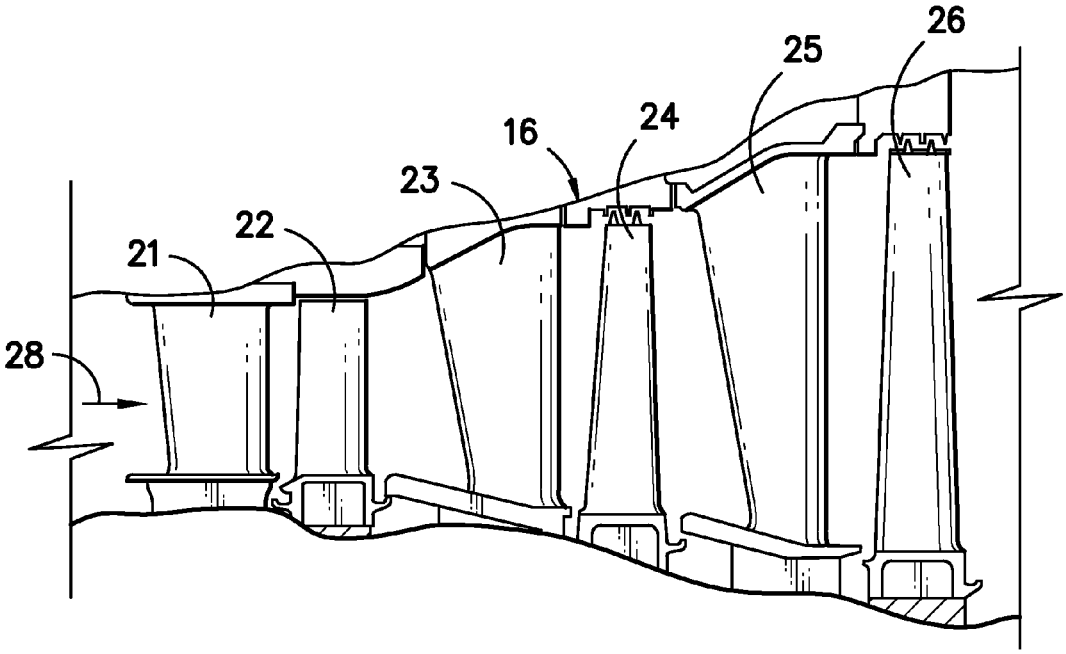
FIG. 2 is a sectional side view of the turbine section of a gas turbine system according to one embodiment of the present disclosure.

The turbine 16 may include a plurality of turbine stages. For example, in one embodiment, the turbine 16 may have three stages, as shown in FIG. 2. For example, a first stage of the turbine 16 may include a plurality of circumferentially spaced nozzles 21 and buckets 22. The nozzles 21 may be disposed and fixed circumferentially about the shaft 18. The buckets 22 may be disposed circumferentially about the shaft 18 and coupled to the shaft 18 by a rotor wheel 20. A second stage of the turbine 16 may include a plurality of circumferentially spaced nozzles 23 and buckets 24. The nozzles 23 may be disposed and fixed circumferentially about the shaft 18. The buckets 24 may be disposed circumferentially about the shaft 18 and coupled to the shaft 18 by a rotor wheel 20. A third stage of the turbine 16 may include a plurality of circumferentially spaced nozzles 25 and buckets 26. The nozzles 25 may be disposed and fixed circumferentially about the shaft 18. The buckets 26 may be disposed circumferentially about the shaft 18 and coupled to the shaft 18 by a rotor wheel 20. The various stages of the turbine 16 may be disposed in the turbine 16 in the flow path of hot gas 28. As the hot gas 28 flows through the turbine stages, the buckets 22, 24, 26 and rotor wheels 20 may rotate about the shaft 18, as is generally known in the art. It should be understood that the turbine 16 is not limited to three stages, but may have any number of stages known in the turbine art.

Figure 3:
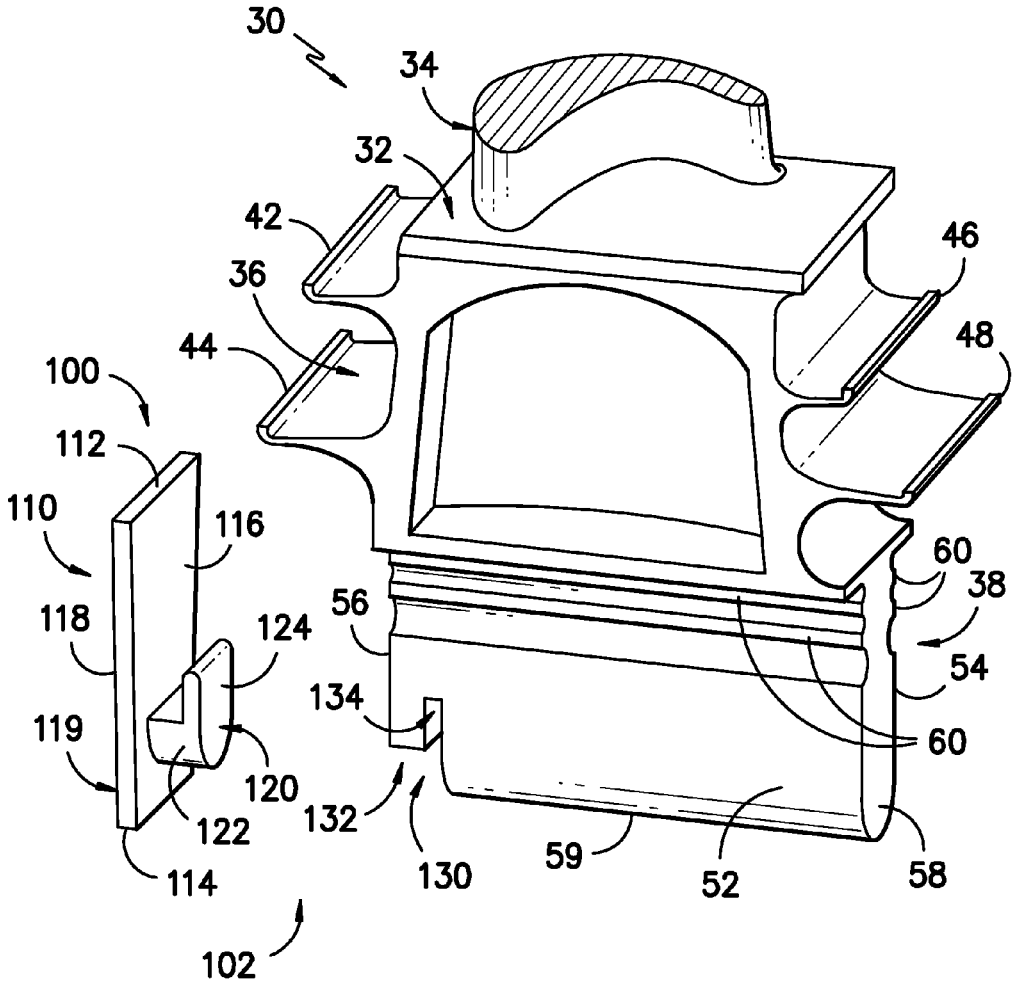
FIG. 3 is an exploded perspective view of one embodiment of a bucket assembly and sealing device of the present disclosure.

Each of the buckets 22, 24, 26 may comprise a bucket assembly 30, as shown in FIG. 3. The bucket assembly 30 may include a platform 32, an airfoil 34, and a shank 36. The airfoil 34 may extend radially outward from the platform 32. The shank 36 may extend radially inward from the platform 32. The shank 36 may include a plurality of angel wings. For example, in one embodiment, the shank 36 may include an upstream upper angel wing 42, upstream lower angel wing 44, downstream upper angel wing 46, and downstream lower angel wing 48.

Figure 4:
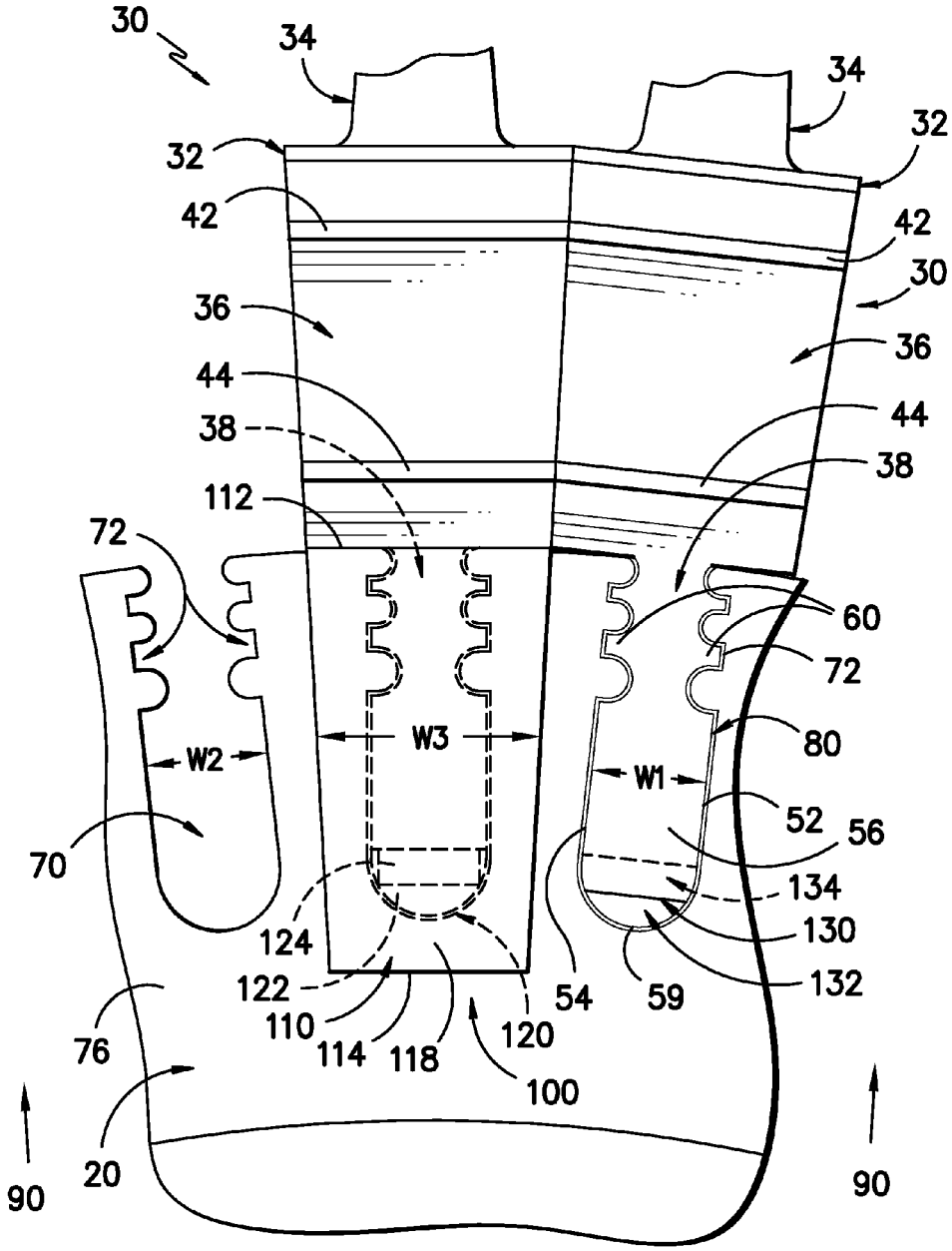
FIG. 4 is a partial front view of one embodiment of a rotor wheel, a plurality of bucket assemblies, and a sealing device of the present disclosure.

The bucket assembly 30 may further include a dovetail 38. The dovetail 38 may extend radially inward from the shank 36. The dovetail 38 may provide an interface between the bucket assembly 30 and the rotor wheel 20. For example, the dovetail 38 may include a pressure side surface 52, a suction side surface 54, an upstream surface 56, a downstream surface 58, and a base surface 59. The dovetail 38 may further include a plurality of tangs 60. The tangs 60 may extend from the pressure side surface 52 and the suction side surface 54, and may facilitate the interface between the bucket assembly 30 and the rotor wheel 20. As shown in FIG. 4, for example, the rotor wheel 20 may define a plurality of circumferentially-spaced slots 70. Each slot 70 may include a plurality of cavities 72. The slots 70 and cavities 72 may be sized to accommodate the dovetails 38 of bucket assemblies 30. For example, the cavities 72 may be sized to accommodate the tangs 60. During operation of the system 10, as the rotor wheel 20 rotates about the shaft 18 and the bucket assemblies 30 are subjected to a radially-outward centrifugal force 90, the cavities 72 may retain the tangs 60 therewithin, thus maintaining the interface between the dovetails 38 and the rotor wheel 20.

The dovetails 38 may further have widths W1. Width W1 may generally be measured across the upstream surface 56 or downstream surface 58 at any point on the dovetail 38, and may vary from point to point along the dovetail 38. For example, the width W1 across portions of the dovetail 38 including tangs 60 may be wider than the width W1 across other portions of the dovetail 38. Further, the dovetail 38 may taper or have any other shape or design known in the art.

The slots 70 may further define widths W2. Similar to the dovetails 38, the widths W2 of the slots 70 may vary. Further, the width W2 of a slot 70 may, at any point on the slot 70, be approximately equal to the width W1 of the associated dovetail 38.

As discussed above, the slots 70 in the rotor wheels 20 may accommodate the dovetails 38 of the buckets assemblies 30, such that the dovetails 38 provide an interface between the bucket assemblies 30 and the rotor wheels 20 of the present disclosure. However, a gap 80 or plurality of gaps 80 may exist at this interface. For example, a gap 80 may exist between the periphery of a dovetail 38 and the periphery of a slot 70 adjacent the upstream surface 56 of the dovetail 38 and an upstream surface 76 of the rotor wheel 20, as shown in FIG. 4, or adjacent the downstream surface 58 of the dovetail 38 and a downstream surface (not shown) of the rotor wheel 20. As hot gas 28 flows through the turbine 16 and past the rotor wheels 20 and bucket assemblies 30, a portion of the hot gas 28 may thus be ingested into these gaps 80, potentially raising the temperature of the rotor wheels 20 and bucket assemblies 30 and causing these components to fail. Thus, sealing devices 100 may be utilized with the dovetails 38, forming dovetail assemblies 102, to prevent the ingestion of hot gas 28 at the interfaces between the bucket assemblies 30 and the rotor wheels 20.

The sealing device 100 of the present disclosure may be utilized to seal a gap 80 in an interface between a dovetail 38 of a bucket assembly 30 and a rotor wheel 20 in a gas turbine system 10. Further, the sealing device 100 may be included with a dovetail 38 to comprise a dovetail assembly 102. The dovetail assembly 102 may provide an interface between a bucket assembly 30 and a rotor wheel 20 in a gas turbine system 10.

The sealing device 100 may include, for example, a cover plate 110. The cover plate 110 may generally be disposed adjacent the dovetail 38 and rotor wheel 20, and may be configured to cover the gap 80. For example, in an exemplary embodiment, the cover plate 110 may be disposed adjacent the upstream surface 56 of the dovetail 38 and the upstream surface 76 of the rotor wheel 20. In another embodiment, the cover plate 110 may be disposed adjacent the downstream surface 58 of the dovetail 38 and the downstream surface of the rotor wheel 20. Further, cover plates 110 may be disposed adjacent both the respective upstream surfaces and downstream surfaces.

The cover plate 110 may include an upper end 112, a lower end 114, an inner surface 116, and an outer surface 118. The cover plate 110 may further include a lower lip portion 119. The lower lip portion 119 may generally be a portion of the cover plate 110 that extends between the lower portion of the gap 80 and the lower end 114.

The cover plate 110 may have any suitable shape and size for covering the gaps 80 between the dovetail 38 and rotor wheel 20. For example, the cover plate 110 may generally have a width W3. The width W3 may generally be measured across the inner surface 116 or outer surface 118 at any point on the cover plate 110, and may vary from point to point along the cover plate 110. In general, the width W3 at any point on the cover plate 110 may be wider than the width W1 of the dovetail 38 and the width W2 of the slot 70, as shown in FIG. 4. Thus, the cover plate 110 may cover the gap 80.

In certain embodiments, the cover plate 110 may be generally rectangular. Thus, the width W3 of the cover plate 110 at the upper end 112 may be approximately equal to the width W3 of the cover plate 110 at the lower end 114. In other embodiments, the cover plate 110 may be generally trapezoidal. For example, as shown in FIGS. 8 and 9, in certain exemplary embodiments, the width W3 of the cover plate 110 at the upper end 112 may be greater than the width W3 of the cover plate 110 at the lower end 114, while in other exemplary embodiments, the width W3 of the cover plate 110 at the lower end 114 may be greater than the width W3 of the cover plate 110 at the upper end 112. Further, in some exemplary embodiments, as shown in FIG. 8, the trapezoidal cover plates 110 disposed adjacent each other in an annular array of bucket assemblies 30 about a rotor wheel 20 may each have a width W3 at the upper end 112 that is greater than the width W3 at the lower end 114. In alternative exemplary embodiments, as shown in FIG. 9, the relative widths W3 at the upper end 112 and lower end 114 of the trapezoidal cover plates 110 disposed adjacent each other in an annular array of bucket assemblies 30 about a rotor wheel 20 may alternate. In this embodiment during operation of the system 10, as the rotor wheel 20 rotates about the shaft 18 and the bucket assemblies 30 are subjected to radially-outward centrifugal force 90, the adjacent cover plates 110 may seal against each other and minimize any radially-outward movement.

The sealing device 100 may further include a retention member 120. The retention member 120 may protrude from the cover plate 110 and be configured to engage the dovetail 38. For example, the retention member 120 may extend from the inner surface 116 of the cover plate 110. Further, the retention member 120 may be disposed proximate the lower end 114 of the cover plate 110. In exemplary embodiments, the retention member 120 may be spaced from the lower end 114 by the lower lip portion 119.

The retention member 120 may engage the dovetail 38. For example, the dovetail 38 may define a retention slot 130 configured to accept and engage the retention member 120. In an exemplary embodiment, the retention slot 130 may be a cutaway portion of the dovetail 38 adjacent the upstream surface 56 and the base surface 59.

The retention member 120 may include a variety of retention portions for retaining the sealing device 100. For example, in one exemplary embodiment, the retention member 120 may include a radial retention portion 122 and an axial retention portion 124. The radial retention portion 122 may prevent the sealing device 100 from moving radially when the sealing device 100 is subjected to radially-outward centrifugal force 90. The axial retention portion 124 may prevent the retention member 100 from moving axial away from the dovetail 38.

The retention slot 130 may include a variety of retention portions for accommodating and engaging the various retention portions of the retention member 120. For example, in an exemplary embodiment, the retention slot 130 may include a radial retention portion 132 and an axial retention portion 134 for accommodating and engaging the radial retention portion 122 and axial retention portion 124 of the retention member 120.

The sealing device 100 of the present disclosure may provide a seal against the gap 80 when the bucket assembly 30 is subjected to a centrifugal force 90. For example, by covering the gap 80, the cover plate 110 provides a seal to the gap 80, preventing hot gas 28 from being ingested therein. The addition of adjacent cover plates 110 of adjacent sealing devices 100 when the sealing device 100 is disposed with a bucket assembly 30 in an annular array about a rotor wheel 20 further provides a seal to the gap 80, by preventing hot gas 28 from flowing around the cover plates 110 into the gaps 80.

Further, as discussed above, during operation of the system 10, as the rotor wheel 20 rotates about the shaft 18, the bucket assemblies 30 and sealing devices 100 are subjected to radially-outward centrifugal force 90. In exemplary embodiments when subjected to centrifugal force 90, the cover plate 110 may pivot about the retention member 120 to further provide a seal against the gap 80. For example, the location of the center of gravity in the sealing device 100 may be such that the application of centrifugal force 90 creates a moment on the sealing device 100 about the retention member 120, thus causing the retention member 120 to act as a pivot point for the cover plate 110.

In some exemplary embodiments, as shown in FIGS. 6 and 7, the sealing device 100 may further engage an angel wing of the bucket assembly 30. For example, as shown in FIG. 6, the upstream lower angel wing 44 may be shaped to provide an engagement slot 140 for the upper end 112 of the cover plate 110. Alternatively, as shown in FIG. 7, the engagement slot 140 may be cut out of the upstream lower angel wing 44. Alternatively, the upper end 112 of the cover plate 110 may engage the downstream lower angel wing 48. The engagement of the sealing device 100 with an angel wing of the bucket assembly 30 may further axially and radially retain the sealing device 100 with respect to the dovetail 38.

The sealing device 100 of the present disclosure advantageously seals gaps 80 in the interface between a dovetail 38 of a bucket assembly 30 and a rotor wheel 20 in a gas turbine 10. Further, the sealing device 100 attaches directly to the dovetail 38, through the engagement of a retention member 120 by a retention slot 130 in the dovetail 38. The sealing device 100 of the present disclosure may further be retro-fitted to existing dovetails 38 by simply removing a portion of the dovetail 38 to define the retention slot 130, and requires no modification of the rotor wheel 20 or any other component of the bucket assembly 30.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A sealing device for sealing a gap between a dovetail of a bucket assembly and a rotor wheel, the sealing device comprising:

a cover plate configured to cover the gap and contact one of upstream surfaces or downstream surfaces of the dovetail and the rotor wheel; and a retention member protruding from the cover plate and configured to engage the dovetail, wherein the sealing device provides a seal against the gap when the bucket assembly is subjected to a centrifugal force.

2. The sealing device of claim 1, wherein the retention member is disposed proximate a lower end of the cover plate.

3. The sealing device of claim 1, wherein the cover plate includes a lower lip portion.

4. The sealing device of claim 3, wherein the retention member is spaced from a lower end of the cover plate by the lower lip portion.

5. The sealing device of claim 1, wherein the retention member includes a radial retention portion and an axial retention portion.

6. The sealing device of claim 1, wherein the cover plate is a generally trapezoidal cover plate having an upper end, a lower end, and a width.

7. The sealing device of claim 6, wherein the width at the upper end is greater than the width at the lower end.

8. The sealing device of claim 6, wherein the width at the lower end is greater than the width at the upper end.

9. The sealing device of claim 1, wherein when the bucket assembly is subjected to a centrifugal force, the cover plate pivots about the retention member to further provide the seal against the gap.

10. A dovetail assembly for providing an interface and sealing a gap between a bucket assembly and a rotor wheel, the dovetail assembly comprising:

a dovetail having an upstream surface, a downstream surface, a pressure side surface, a suction side surface, and a base surface, the dovetail defining a retention slot; and a sealing device disposed adjacent the upstream surface, the sealing device comprising a cover plate configured to cover the gap and contact one of upstream surfaces or downstream surfaces of the dovetail and the rotor wheel and a retention member protruding from the cover plate and engaged in the retention slot, wherein the sealing device provides a seal against the gap when the bucket assembly is subjected to a centrifugal force.

11. The dovetail assembly of claim 10, wherein the dovetail and the cover plate each define a width, and wherein the width of the cover plate is generally greater than the width of the dovetail.

12. The dovetail assembly of claim 10, wherein the retention slot includes a radial retention portion and an axial retention portion.

13. The dovetail assembly of claim 12, wherein the retention member includes a radial retention portion configured to engage the radial retention portion of the retention slot and an axial retention portion configured to engage the axial retention portion of the retention slot.

14. The dovetail assembly of claim 10, wherein the retention slot is a cutaway portion adjacent the upstream surface and the base surface.

15. The dovetail assembly of claim 10, wherein the retention member is disposed proximate a lower end of the cover plate.

16. The dovetail assembly of claim 10, wherein the cover plate includes a lower lip portion.

17. The dovetail assembly of claim 16, wherein the retention member is spaced from a lower end of the cover plate by the lower lip portion.

18. The dovetail assembly of claim 10, wherein the cover plate is a generally trapezoidal cover plate.

19. The dovetail assembly of claim 10, wherein when the bucket assembly is subjected to a centrifugal force, the cover plate pivots about the retention member to further provide the seal against the gap.

20. The dovetail assembly of claim 10, wherein the sealing device further engages a bucket assembly angel wing.

* * * * *